US009733015B2

(12) United States Patent
Onose

(10) Patent No.: US 9,733,015 B2
(45) Date of Patent: Aug. 15, 2017

(54) DRYING METHOD, DRYING DEVICE, AND DRYING SYSTEM MAKING USE OF TEMPERATURE DIFFERENTIAL

(71) Applicant: HOKKAIDO TOKUSHUCHIRYOU KABUSHIKIKAISHA, Hokkaido (JP)

(72) Inventor: Kazuhiro Onose, Hokkaido (JP)

(73) Assignee: Hokkaido Tokushuchiryou Kabushikikaisha, Hokkaido (JP)

( * ) Notice: Subject to any disclaimer, the term of this patent is extended or adjusted under 35 U.S.C. 154(b) by 0 days.

(21) Appl. No.: 15/055,945

(22) Filed: Feb. 29, 2016

(65) Prior Publication Data

US 2016/0231057 A1 Aug. 11, 2016

(51) Int. Cl.

| | |
|---|---|
| ***F26B 21/10*** | (2006.01) |
| ***F26B 3/06*** | (2006.01) |
| ***F26B 3/14*** | (2006.01) |
| ***F26B 17/12*** | (2006.01) |
| ***F26B 21/06*** | (2006.01) |
| ***F26B 21/08*** | (2006.01) |

(52) U.S. Cl.

CPC ..... *F26B 21/10* (2013.01); *F26B 3/06* (2013.01); *F26B 3/14* (2013.01); *F26B 17/122* (2013.01); *F26B 21/06* (2013.01); *F26B 21/08* (2013.01)

(58) Field of Classification Search

CPC .... F26B 21/10; F26B 3/06; F26B 3/14; F26B 17/122; F26B 21/06; F26B 21/08

USPC ..... 34/495

See application file for complete search history.

(56) References Cited

U.S. PATENT DOCUMENTS 3,861,057 A * 1/1975 Wittstock ..... F26B 13/103 156/359
4,016,656 A * 4/1977 Batscheider ..... A21D 6/003 34/380

(Continued)

FOREIGN PATENT DOCUMENTS

JP 2011144938 A * 7/2011
JP 2012132647 A * 7/2012
JP 2013128888 A * 7/2013

*Primary Examiner* — Stephen M Gravini
(74) *Attorney, Agent, or Firm* — Weisun Rao; Greenberg Traurig, LLP

(57) ABSTRACT

The present invention provides a drying method to dry a to-be-dried object by allowing the to-be-dried object to contact with gas having a different temperature. The method includes comprising: an introduction process of introducing the to-be-dried object; a first heating/cooling process of heating or cooling the to-be-dried object to have a first temperature; a transportation process of transporting the heated or cooled to-be-dried object; a humidity comparison process of comparing the to-be-dried object humidity of the to-be-dried object with the gas humidity of gas used for dehumidification; an atmosphere temperature adjustment process of adjusting, when the to-be-dried object humidity is high, the temperature of the gas used for dehumidification to a second temperature lower than the first temperature and adjusting, when the gas humidity is high, the temperature of the gas used for dehumidification to the second temperature higher than the first temperature; a dehumidification process of allowing the to-be-dried object to contact with the gas of the second temperature to thereby dehumidify the to-be-dried object; and a removal process of removing the to-be-dried object.

9 Claims, 7 Drawing Sheets

(56) References Cited

U.S. PATENT DOCUMENTS

| | | | | |
|---|---|---|---|---|
| 4,168,579 | A * | 9/1979 | Ericsson | B41F 23/0426 34/535 |
| 4,285,702 | A * | 8/1981 | Michel | E03B 3/28 95/124 |
| 4,597,188 | A * | 7/1986 | Trappler | F26B 21/14 34/287 |
| 6,223,448 | B1 * | 5/2001 | Motzke | B41F 23/02 34/61 |
| 7,730,633 | B2 * | 6/2010 | Jurkovich | A23N 17/005 34/381 |
| 7,987,613 | B2 * | 8/2011 | Ness | C10L 9/08 110/249 |
| 8,117,764 | B2 * | 2/2012 | Ness | C10L 9/08 110/346 |
| 8,869,420 | B1 * | 10/2014 | Nazhad | F26B 21/08 110/342 |
| 9,518,779 | B2 * | 12/2016 | Favaro | A24B 3/04 |
| 2016/0231057 | A1 * | 8/2016 | Onose | F26B 21/10 |
| 2017/0059187 | A1 * | 3/2017 | Smith, Jr. | F24D 19/109 |

* cited by examiner

DRYING METHOD, DRYING DEVICE, AND DRYING SYSTEM MAKING USE OF TEMPERATURE DIFFERENTIAL

REFERENCE TO RELATED APPLICATIONS

This application is a U.S. national phase application of international application No. PCT/JP2014/064513, filed on May 30, 2014, which claims priority to Japanese Application No. 2013-180344, filed on Aug. 30, 2013, the contents of both of which are incorporated herein by reference in their entireties.

FIELD OF THE INVENTION

The present invention relates to drying method and apparatus for performing dehumidification using gas. In particular, the present invention relates to a technique to provide the improvement of a drying efficiency depending on a to-be-dried object and the humidity of gas used for dehumidification.

BACKGROUND OF THE INVENTION

In the solid drying technique, a convection electrical heating drying using hot air and a dehumidification cold air drying technique are known. For example, Patent Publication 1 discloses a food drying method to dry food by blasting food with cold air. According to this publication, food is placed on a transportation conveyor that is arranged to penetrate a drying room including therein an enclosed space and that has many ventholes in a conveyor face and the food is transported into the drying room. Then, dehumidification cool air is sent through nozzles provided at the upper and lower sides of the transportation conveyor to collide with the food. Then, a dehumidification cool air film is formed on the upper and lower surfaces of the food to thereby dry the food while transporting the food in the drying room. This can consequently improve the drying effect while maintaining the food flavor, thereby reducing the drying processing time and always forming a fixed temperature and humidity environment as a drying atmosphere around the food, which eliminates uneven drying.

Patent Publication 2 discloses, for example, a method and an apparatus to continuously dry rice and wet-field rice in particular. This publication has an objective of reducing the processing time and the grain core breakage by carrying out the preliminary cleaning of wet-field rice followed by the drying in a vortex layer to subsequently condition or cool the wet-field rice. Then, the rice is dried at a temperature of about 50 to 55° C. to include about 13% humidity. After being dried, the rice is gradually cooled/conditioned to have a surrounding temperature.

Patent Publication 3 discloses a cereal drying and storage method as well as a cereal drying and storage apparatus by which a single apparatus can provide both of the drying and storage while favorably maintaining the eating quality and quality of the rice.

According to this publication, the cereal drying and storage apparatus includes a heat pump unit. This unit has a ventilation flue including an upper path and a lower path formed by a branch wall. The upper path can be opened or closed by the first damper. The lower path can be opened or closed by the second damper. According to this configuration, when a drying operation is performed, the first damper can be closed and the second damper can be opened to thereby send normal temperature wind for dehumidification into a grain tank. When a storage operation is performed, the first damper can be opened and the second damper can be closed opened to thereby send cool wind for dehumidification into the grain tank. Thus, a single apparatus can provide both of the drying and storage operations.

CITATION LIST

Patent Publication 1: Japanese Patent No. 4961610

Patent Publication 2: Japanese Unexamined Patent Application Publication No. 2007-533939

Patent Publication 3: Japanese Unexamined Patent Application Publication No. H05-000023

SUMMARY OF THE INVENTION

Problem to be Solved by the Invention

Regarding the solid drying technique, various methods have been suggested including a convection electrical heating drying using hot air and a dehumidification cold air drying. However, no method has been suggested to improve the efficiency depending on the status of a to-be-dried object such as the temperature of the to-be-dried object or the temperature of drying air.

It is an objective of the present invention to achieve a shorter drying time, a reduced drying operation cost, and an improved drying efficiency by controlling, depending on the humidity of a to-be-dried object, the temperature of gas used for dehumidification.

Means for Solving the Problem

In order to solve the above disadvantage, the present invention provides a drying method as shown below.

Specifically, the invention according to claim 1 provides a drying method to dry a to-be-dried object by allowing the to-be-dried object to contact with gas having a different temperature, comprising: an introduction process of introducing the to-be-dried object; a first temperature heating/cooling process of heating or cooling the to-be-dried object to have a first temperature; and a transportation process of transporting the heated or cooled to-be-dried object.

The invention also includes a humidity comparison process of comparing the to-be-dried object humidity of the to-be-dried object with the gas humidity of gas used for dehumidification; an atmosphere temperature adjustment process of adjusting, when the to-be-dried object humidity is high, the temperature of the gas used for dehumidification to a second temperature lower than the first temperature and adjusting, when the gas humidity is high, the temperature of the gas used for dehumidification to the second temperature higher than the first temperature; a dehumidification process of allowing the to-be-dried object to contact with the gas of the second temperature to thereby dehumidify the to-be-dried object; and a removal process of removing the to-be-dried object.

The invention according to claim 2 is characterized in that the drying method has, after the dehumidification process, a ventilation process of exchanging the gas used for dehumidification.

The invention according to claim 3 is characterized in having, prior to the removal process, returning the to-be-dried object to the first temperature heating/cooling process to repeat the respective processes.

The invention according to claim 4 is characterized in that the transportation step uses compressed air to perform transportation.

The present invention also can provide a drying apparatus as shown below.

Specifically, the invention according to claim 5 provides a drying apparatus for drying a to-be-dried object by allowing the to-be-dried object to contact with gas having a different temperature, comprising: an introduction means for introducing a to-be-dried object; a first temperature heating/cooling means of heating or cooling the to-be-dried object to have the first temperature; and a transportation means for transporting the to-be-dried object heated or cooled by the first temperature heating/cooling means.

The drying apparatus also includes: a humidity comparison means for measuring the to-be-dried object humidity of the to-be-dried object after the transportation and the gas humidity of gas used for dehumidification to perform comparison therebetween; an atmosphere temperature adjustment means for adjusting, when the to-be-dried object humidity is high, the temperature of the gas used for dehumidification to a second temperature lower than the first temperature and adjusting, when the gas humidity is high, the temperature of the gas used for dehumidification to the second temperature higher than the first temperature; a dehumidification means of allowing the to-be-dried object to contact with the gas of the second temperature to thereby dehumidify the to-be-dried object; and a removal means for removing the to-be-dried object.

The invention according to claim 6 is characterized in that the drying apparatus includes a ventilation means for exchanging the gas used for dehumidification.

The invention according to claim 7 is characterized in that the transportation means integrally forms the introduction means, the first temperature heating/cooling means, and the removal means and is configured by a space having the atmosphere temperature adjustment means, the dehumidification means, and the ventilation means.

The invention according to claim 8 is characterized in that the transportation means performs transportation by compressed air.

The invention according to claim 9 is characterized in that the first temperature heating/cooling means and the atmosphere temperature adjustment means use a heat pump.

Effect of the Invention

Solid drying is ideally carried out in an environment having a lower humidity and a lower temperature than those of a to-be-dried object. The solid drying is mainly carried out by dehumidifying drying air by a dehumidifier or a dehumidification film for example in advance. However, by controlling the temperature of the to-be-dried object and the temperature of the gas used for dehumidification and by ventilating the gas used for dehumidification, a preferred drying environment can be realized.

DETAILED DESCRIPTION OF THE INVENTION

Figure 1:
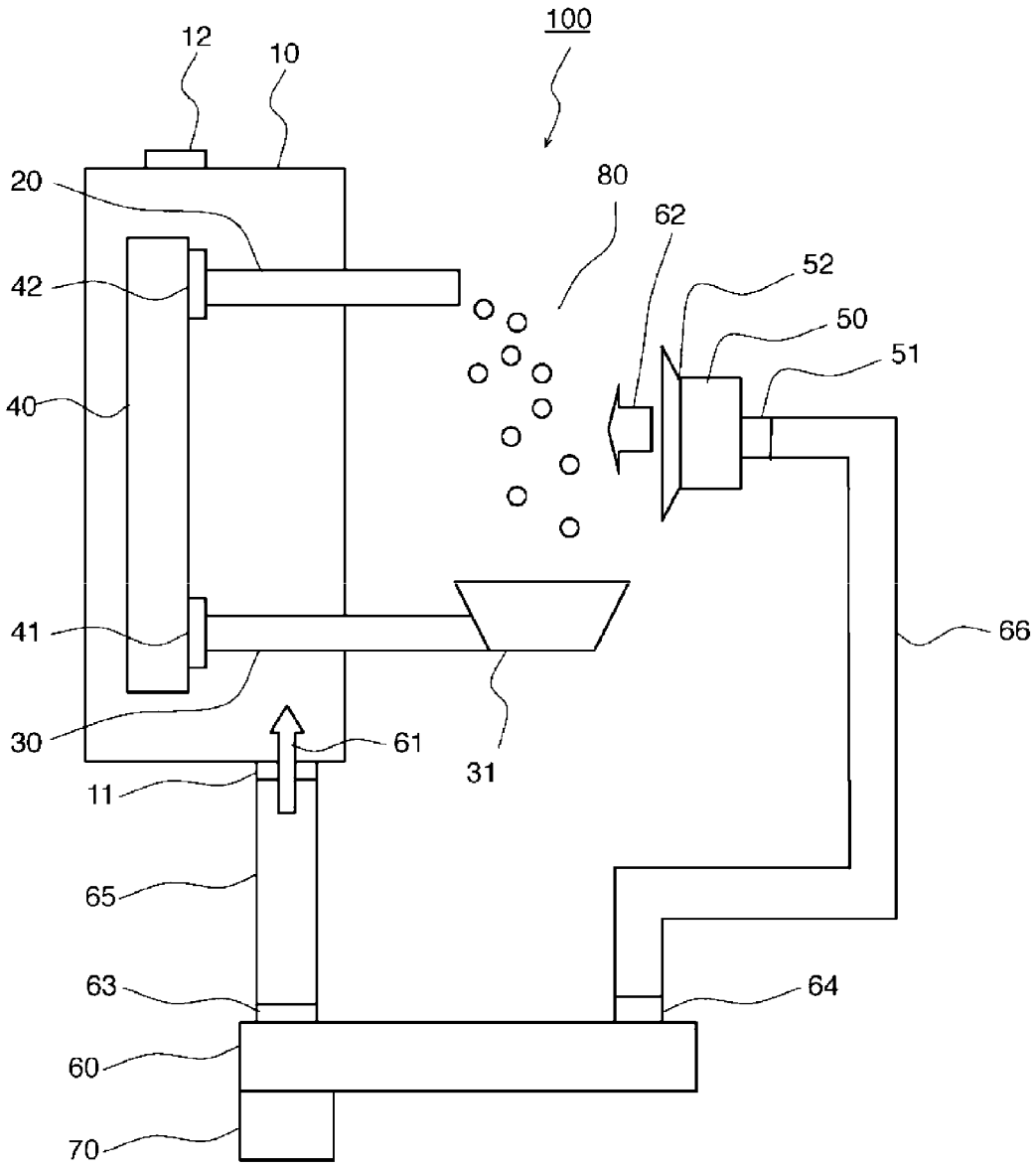
FIG. 1 is a schematic side view illustrating Embodiment 1 of a preferred drying apparatus of the present invention.

The following section will describe in detail the present invention using an embodiment shown in the drawings. However, it is not intended that the scope of this invention is limited to the size, material, shape, relative layout, or the like of components shown in this embodiment unless a specific description in particular is described.

Embodiment 1

The following section will describe the first embodiment applied for the drying of food grain or the like based on FIG. 1.

A drying apparatus 100 of the first embodiment is configured so that a to-be-dried object is released from a temperature control unit 10 as a first temperature heating/cooling means to an open space 80 to dehumidify the to-be-dried object by wind sent from an air blower 50. The air blower 50 receives air through an inlet 51 and sends wind through an exhaust nozzle 52. The wind received in the open space 80 is used to dry food grain or the like.

The temperature control unit 10 includes an upper transportation apparatus 20 to release a to-be-dried object to the open space 80 and a lower transportation apparatus 30 to transport the hopper 31 that receives the to-be-dried object dehumidified in the open space 80. An elevating apparatus 40 is also provided that transports the to-be-dried object from the lower transportation apparatus 30 to the upper transportation apparatus 20.

The elevating apparatus 40 includes an introduction opening 41 for the to-be-dried object and a discharge opening 42 for the to-be-dried object. The to-be-dried object introduced from the lower transportation apparatus 30 through the introduction opening 41 of the elevating apparatus 40 is upwardly sent within the temperature control unit 10 while being heated or cooled to the first temperature.

The temperature control unit 10 has an intake vent 11 of air 61 to control the temperature of the to-be-dried object and an exhaust vent 12 of the air 61 and is cased to generally form an enclosed space.

Air 62, which is used to dehumidify the to-be-dried object dropped from the upper transportation apparatus 20 to the lower transportation apparatus 30 in the open space 80, has a temperature adjusted by a heat pump unit 60 including the first air supply opening 63 and the second air supply opening 64.

The heat pump unit 60 has a function to switch airs of two temperatures of the air 61 to control the temperature of the to-be-dried object and the air 62 used for the dehumidification. The heat pump unit 60 has the first duct 65 for providing the communication between the first air supply opening 63 and the intake vent 11 and the second duct 66 for providing the communication between the second air supply opening 64 and the inlet 51.

The following section will describe a method of drying a to-be-dried object by this drying apparatus 100.

A to-be-dried object is introduced from the introduction opening 41 of the elevating apparatus 40 to the temperature control unit 10 for the to-be-dried object and is transported by the elevating apparatus 40 to the upper transportation apparatus 20 while being heated or cooled. The to-be-dried object is released by the upper transportation apparatus 20 into the release space 80 and is dropped while being exposed to the air 62 used for the dehumidification cooled or heated by a release space 80 and is stored in the hopper 31 of the lower transportation apparatus 30.

The to-be-dried object is again transported by the elevating apparatus 40 to the upper transportation apparatus 20 and is dried by repeating the series of processes. The dried object is discharged through the discharge opening 42 of the elevating apparatus 40.

Food grain or the like is dried mainly by drying a to-be-dried object by a method of using hot air generated by fire power. The to-be-dried object after being dried includes therein moisture content similar to that in the water in atmospheric air. Thus, a suitable method is to gradually dry a to-be-dried object by warm air and to dry the to-be-dried object by cold air. However, when the air humidity exceeds the humidity of the to-be-dried object, it is preferred to cool the to-be-dried object and to dry the to-be-dried object by warm air. Depending on the humidity of the to-be-dried object, airs having two temperatures supplied from the heat pump unit are switched to thereby improve the efficiency.

In order to realize this, the present invention provides a control apparatus 70 that controls, depending on the humidity of the to-be-dried object, the temperature of the to-be-dried object and the temperature of the air 62 used for dehumidification.

The control apparatus 70 is connected to a humidity sensor that measures the humidity of a to-be-dried object released from the upper transportation apparatus 20 and a humidity sensor that measures the humidity of air sent from the exhaust nozzle 52 of the air blower 50 and compares the humidities of the former and the latter. Specifically, the control apparatus 70 functions as a humidity comparison means according to the present invention.

When the result of the humidity comparison shows that the to-be-dried object humidity is high, the temperature of the air 62 used for dehumidification is adjusted to the second temperature lower than a set temperature in the temperature control unit 10 (the first temperature). The atmosphere temperature adjustment means as described above is realized by allowing the control apparatus 70 to control the heat pump unit 60.

When the air 62 has a high humidity on the other hand, the temperature of the gas used for dehumidification is adjusted to the second temperature higher than the set temperature in the temperature control unit 10.

As described above, the configuration of this embodiment can use the heat pump unit to control both of the temperature of the air 61 introduced to the temperature control unit 10 and the temperature of the air 62 used for dehumidification sent from the air blower. Thus, the above relation also can be achieved by changing not only the second temperature but also the temperature of the temperature control unit 10.

In the present invention, the wind sent from the air blower 50 is released into the open space 80. Thus, the air 62 used for dehumidification is always ventilated without being collected.

According to a test by the present inventor, the air 62 used for dehumidification can be ventilated to thereby further improve the dehumidification effect.

Embodiment 2

Figure 2:
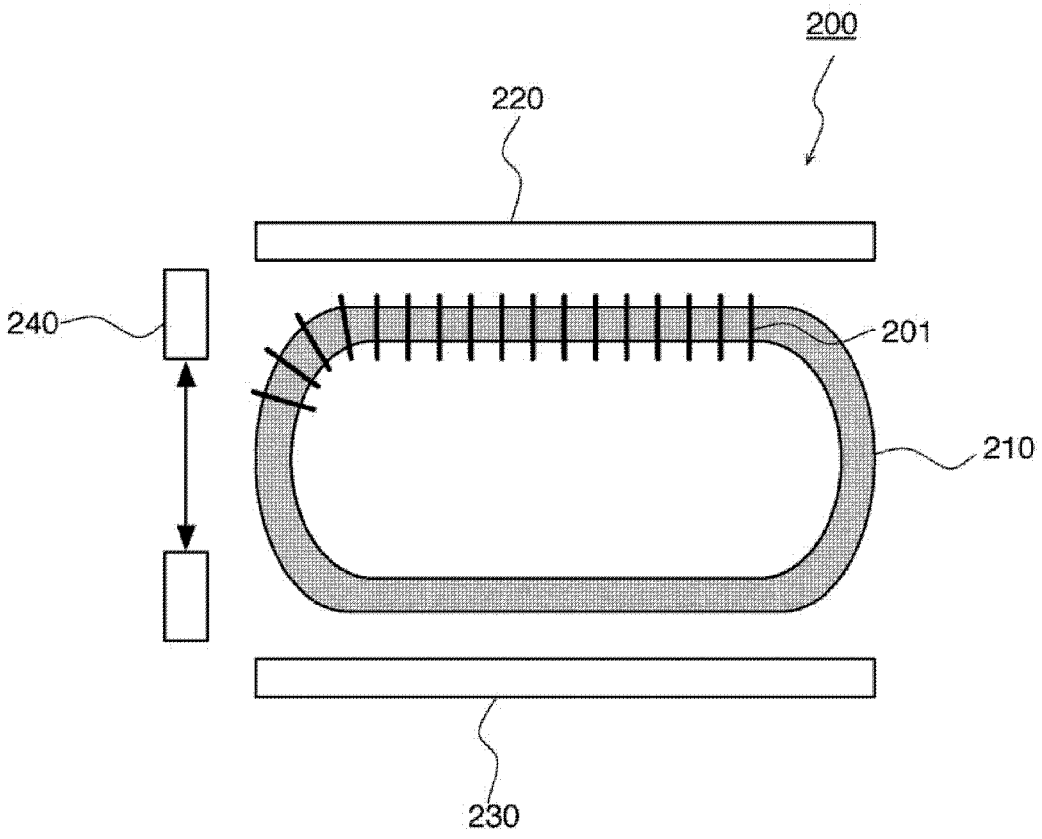
FIG. 2 is a schematic top view illustrating Embodiment 2 of the preferred drying apparatus of the present invention.

The following section will describe the second embodiment applied to the drying of clothing or the like based on FIG. 2. The drying apparatus 200 of the second embodiment is composed of: a ring-like conveyor 210 attached with a plurality of hangers for hanging clothing or the like; a heating apparatus 220 provided in the vicinity of the conveyor; a cooling apparatus 230 provided to be opposed to the heating apparatus in the vicinity of the conveyor so that the conveyor is sandwiched between the cooling apparatus 230 and the heating apparatus; and a mobile ventilation fan 240.

The to-be-dried object 201 is dried by repeating a step of heating the to-be-dried object 201 hanged from the hanger rotated by the ring-like conveyor 210 and a step of cooling the to-be-dried object 201 by the cooling apparatus 230.

When the to-be-dried object 201 has a humidity higher than that of air, air near the cooling apparatus is ventilated by the ventilation fan 240 in a forced manner. When the to-be-dried object 201 has a humidity lower than that of air, the air near the heating apparatus 220 is ventilated by the ventilation fan 240 in a forced manner.

In order to realize this, as in the above embodiment, humidity sensors are provided to measure and compare the humidity of the to-be-dried object and the air humidity to control the ventilation fan by switching.

This configuration can be used to dry clothing or the like efficiently.

Embodiment 3

Figure 3:
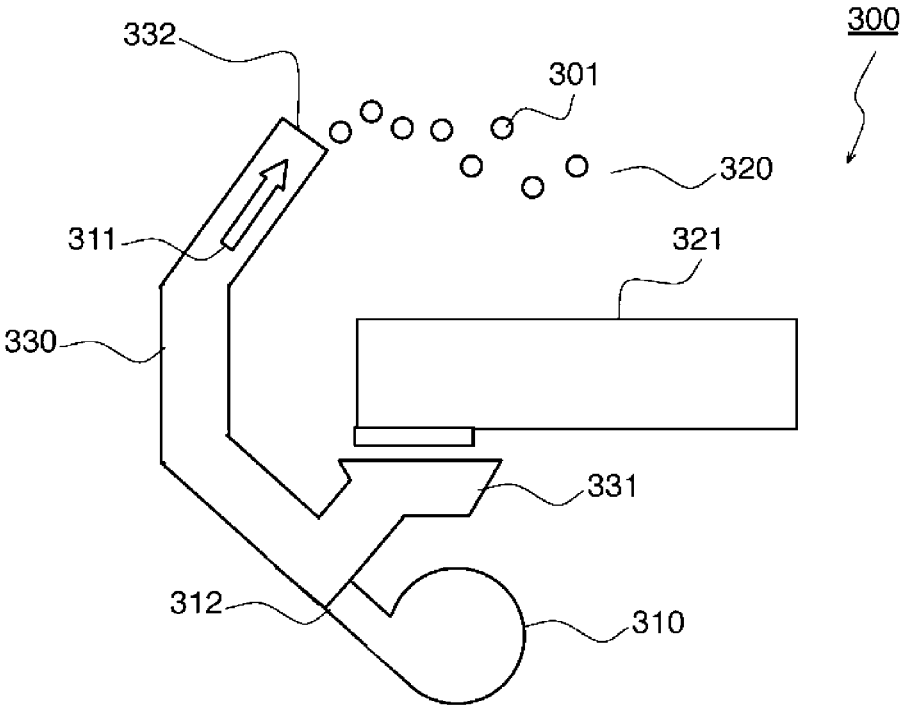
FIG. 3 is a schematic side view illustrating Embodiment 3 of the preferred drying apparatus of the present invention.

The following section will describe the third embodiment applied to the drying of closing such as cotton work gloves, socks, and the like based on FIG. 3. The drying apparatus 300 of the third embodiment includes a storage bath 321 of a to-be-dried object 301, an inlet 331 through which the to-be-dried object is sent from the storage bath 321, and a duct 330 extending from the inlet to a discharge opening 320. Through the discharge opening, the to-be-dried object is released to a space 320 in which air used for dehumidification is cooled and heated and ventilated.

At the same time, a compressed air generation apparatus 310 is provided that sends compressed air through an exhaust vent 312 from the rear side of the duct.

In this embodiment, the to-be-dried object 301 is sent to the duct 330 from the inlet 331 by the action by compressed air 311 including the compression heat generated in the compressed air generation apparatus 310 and is transported through the duct 330. Then, the to-be-dried object 301 is released together with the compressed air 311 released through a discharge opening 332 while having a decreasing temperature. Then, the to-be-dried object 301 is released into the space 320 and is stored in the storage bath 321. The space 320 includes the storage bath 321 for the to-be-dried object and is used to cool and heat and to ventilate the gas used for dehumidification.

The to-be-dried object 301 is dried by being heated by the compressed air 311 and by being released to have a decreased temperature in the space 320 used to cool and heat and to ventilate the gas used for dehumidification.

Embodiments 4 to 6

Figure 4:
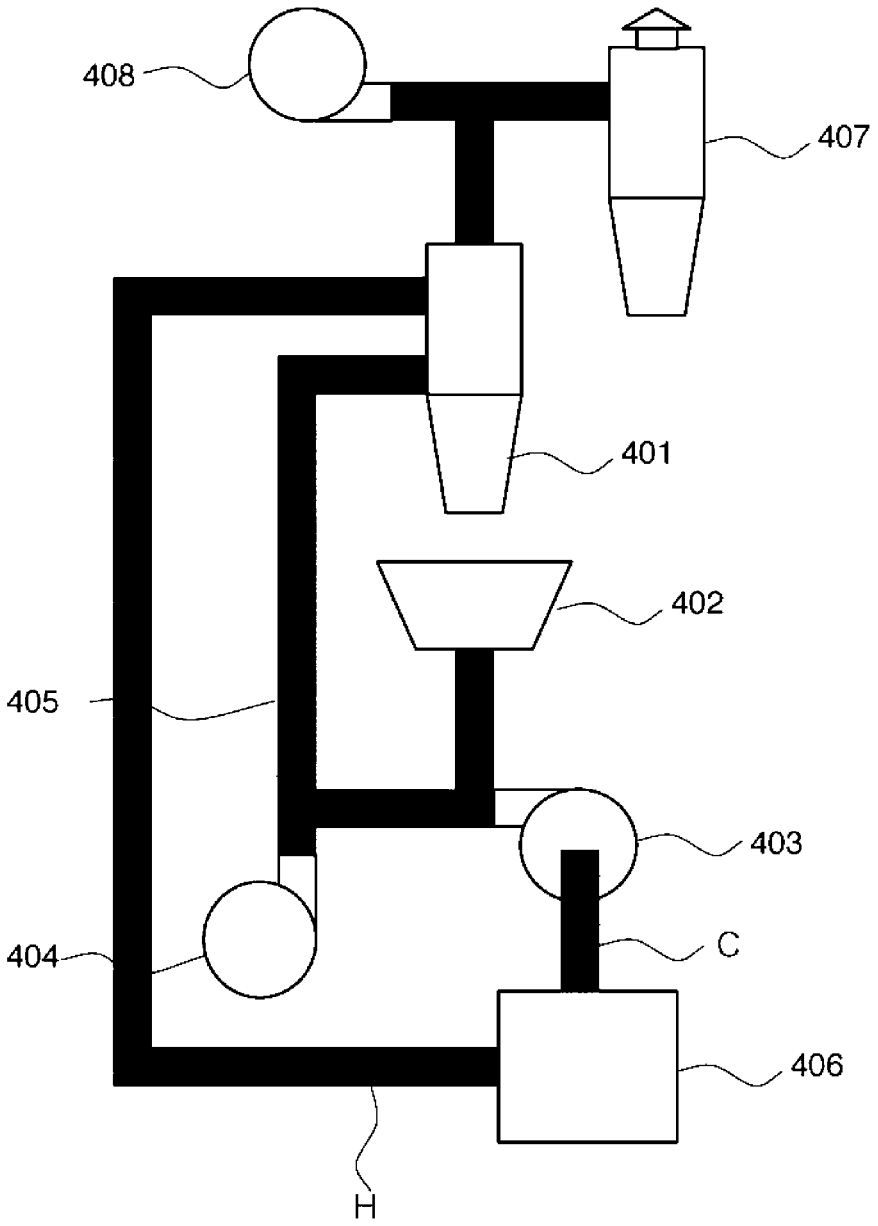
FIG. 4 is a schematic side view illustrating Embodiment 4 of the preferred drying apparatus of the present invention.
Figure 5:
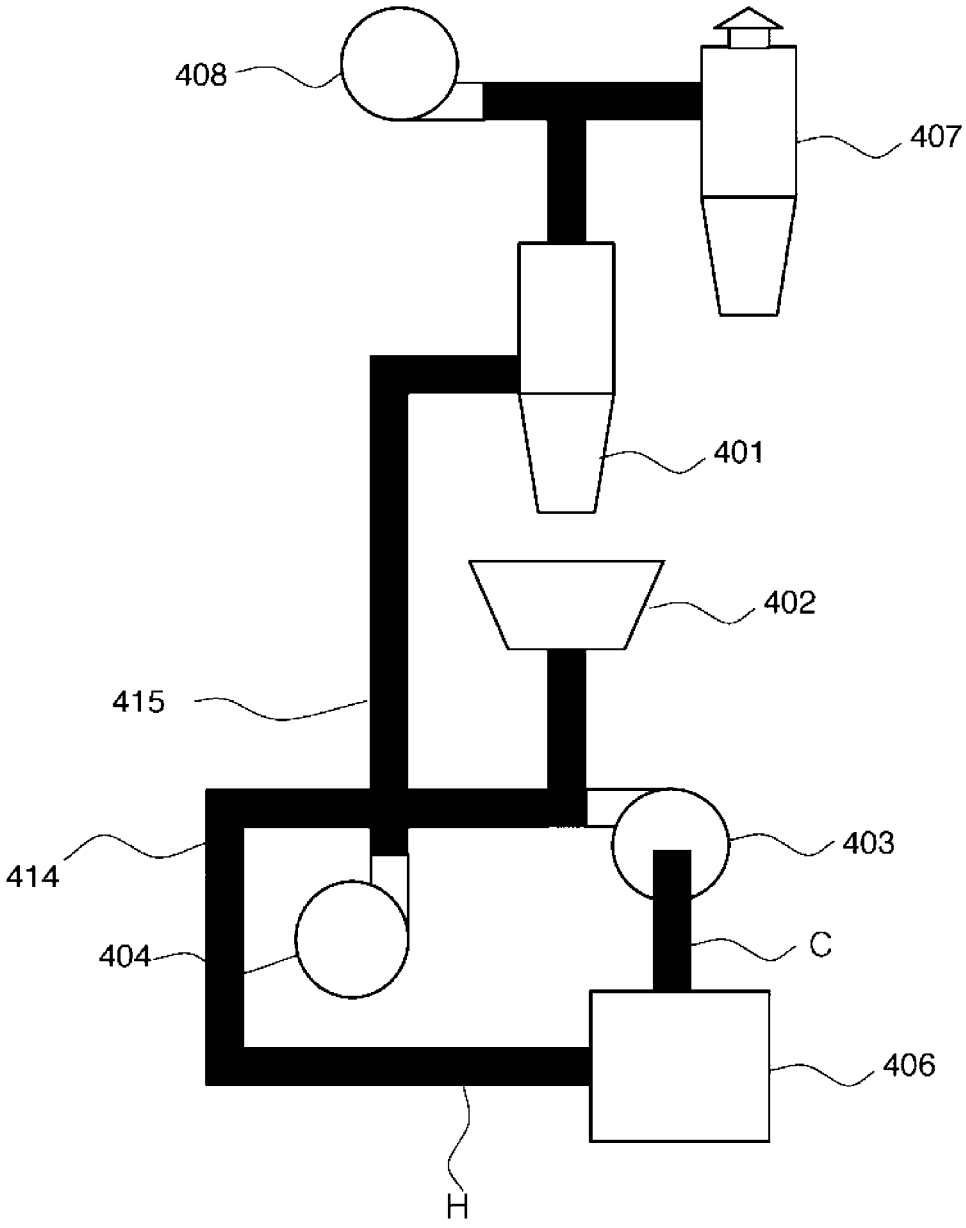
FIG. 5 is a schematic side view illustrating Embodiment 5 of the preferred drying apparatus of the present invention.
Figure 6:
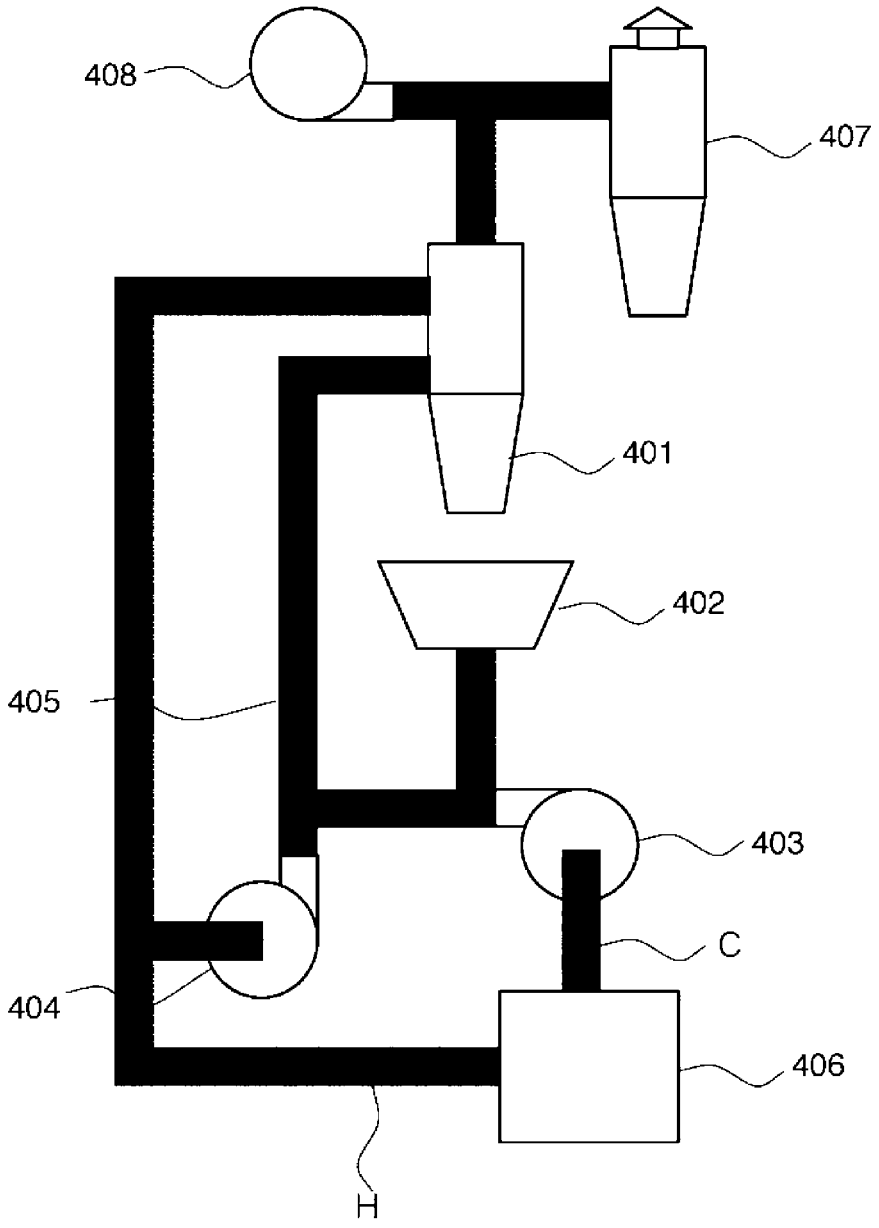
FIG. 6 is a schematic side view illustrating Embodiment 6 of the preferred drying apparatus of the present invention.

FIGS. 4 to 6 illustrate embodiments in which a drying method according to the present invention is used in a system using cyclone. In the respective embodiments, components having the same reference numeral have the same function.

In the respective embodiments, the to-be-dried object together with dehumidification cool temperature air compressed by a blower can be released into the cyclone functioning as an open space having a high temperature to thereby efficiently dry the to-be-dried object.

In the systems of FIG. 4 to FIG. 6, a cyclone 401 functioning as a solid-gas separation means is surrounded as a center by a dust collection cyclone 407 also contributing to the ventilation in the cyclone 401. The dust collection cyclone 407 also can include a blower 408 that is also used to discharge a product for which the solid-gas separation by the cyclone 401 is completed.

The to-be-dried object in the middle of the drying process is dropped from the lower side of the cyclone 401 to a hopper 402. The hopper 402 functions as a storage means and a transfer means. The circulated to-be-dried object is transferred by a provided screw conveyor into a lower duct.

A circulation the duct 405 includes two blowers 403 and 404 in the middle thereof. Compressed air supplied in the blowers 403 and 404 is used not also to transfer the to-be-dried object for circulation but also to heat and cool the to-be-dried object according to the present invention.

A heat pump unit 406 is further included that supplies cold air to a blower 403 and supplies warm air to the cyclone 401 for example.

This embodiment also can be configured so that the humidity of a to-be-dried object and the humidity of dehumidification air in the duct 405 are measured and comparted to control the temperatures of airs supplied to the cyclone 401 and a duct 405, respectively.

Thus, this system also can provide a favorable drying efficiency of the present invention.

Embodiment 5 shown in FIG. 5 has a configuration in which the warm air from the heat pump unit 406 is connected through a duct 414 to a circulation duct 415. Thus, Embodiment 5 shown in FIG. 5 has a configuration in which the temperature of the dehumidification air in the circulation duct 415 is adjusted so as not to be controlled independent of the temperature supplied to the cyclone 401.

Embodiment 6 of FIG. 6 has a configuration in which the warm air from the heat pump unit 406 is supplied not only to the cyclone 401 in Embodiment 4 but also to the circulation the duct 405. Specifically, warm air is supplied to a blower 404. In this case, the control of the blower 404 also can be used to adjust the temperature of the air in the circulation the duct 405 (the second temperature).

In the systems shown in Embodiments 4 to 6, positions at which a to-be-dried object is inputted or discharged, for example, are not limited. The apparatus also can be freely designed to simplify the increase and decrease of the size.

The following section will describe a method of controlling a temperature according to the present invention.

An experiment by the present inventor shows that the control as shown below is preferred. Specifically, (a) When a to-be-dried object has a higher humidity and a higher temperature than those of drying gas, it is optimal that the drying gas has a low humidity and a low temperature so that the ventilation of the drying gas provides a higher efficiency.

(b) When a to-be-dried object has a higher humidity and a lower temperature than those of drying gas, it is optimal that the drying gas has a low humidity and a high temperature so that the ventilation of the drying gas provides a higher efficiency.

(c) When a to-be-dried object has a lower humidity than that of drying gas, it is optimal that the drying gas has a high temperature so that the saturated vapor amount of the to-be-dried object is lower than the saturated vapor amount of the drying gas so that the ventilation of the drying gas provides a higher efficiency.

Also according to the present invention, a pressure change in the drying apparatus also can be used to improve the drying efficiency.

Specifically, solid-gas separation is preferably carried out by shifting from a high pressure environment to a low pressure environment. The shift from a high pressure to a low pressure releases a to-be-dried object and the low temperature causes ventilation, thus providing an improved efficiency. The use of compressed air to transport the to-be-dried object can generate a high pressure environment to cause solid-gas separation to release the to-be-dried object. The generation of low temperature causes ventilation, thereby providing an improved efficiency.

The to-be-dried object is transferred, while being heated, by compressed drying gas having a low humidity and a high temperature to a release environment having a low humidity and is released by the solid-gas separation and the drying gas is discharged. By repeatedly performing the series of steps, an improved efficiency is provided.

The use of the heat pump also can transfer a to-be-dried object by compressed drying gas having a low humidity and a high temperature to the release environment having a low humidity while heating the to-be-dried object and can release the to-be-dried object by the solid-gas separation and the drying gas is discharged. An improved efficiency also can be provided by repeatedly performing the series of steps.

Figure 7:
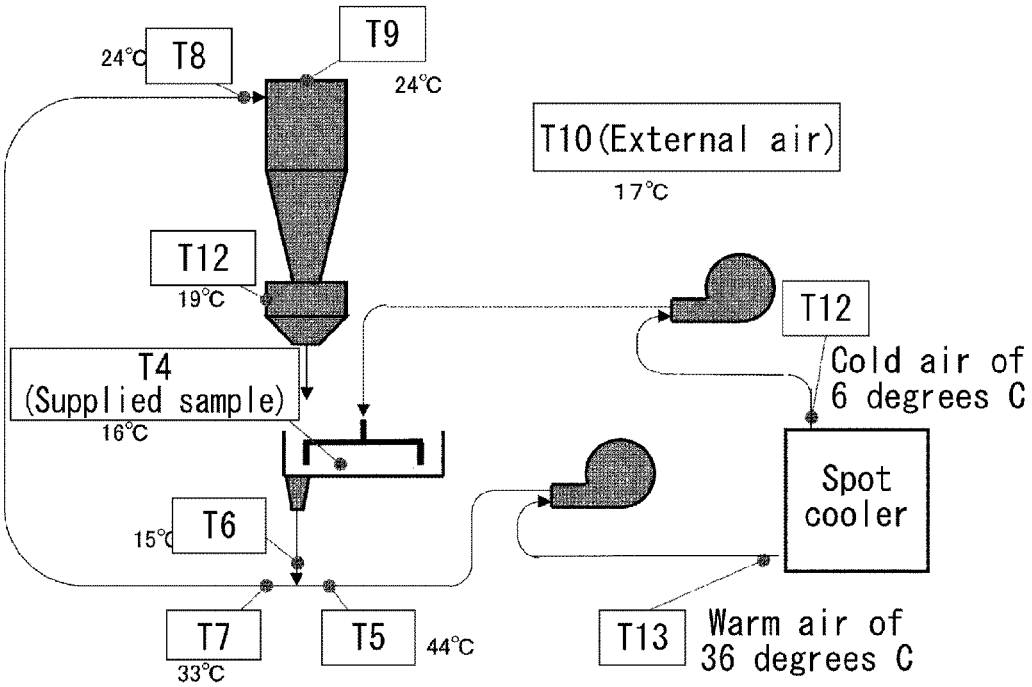
FIG. 7 illustrates an experiment example of the drying apparatus.

The following section will describe an experiment example of the present invention using FIG. 7.

Depending on the humidity and the temperature of the to-be-dried object, the temperature of the gas used for dehumidification is controlled. The to-be-dried object is supplied from a mixer-type hopper to a circulation duct through an ejector and is transported by transportation air also functioning as drying air from a vortex blower to cyclone and is subjected to solid-gas separation by cyclone and is returned to the mixer-type hopper. This process is repeated to dry the object. The vortex blower is used to supply drying air used for aeration. The heat pump provides warm air used as transportation air and cold air used for aeration.

In this experiment, the warm air of 36° C. (T3) from the spot cooler is sent to the vortex blower (transportation air) and the cold air of 6° C. (T2) is supplied via the vortex blower to the mixer-type hopper through a rotary vane.

The compressed air ejected from the vortex blower has a temperature (T5) of 44° C. and the ejector has a temperature (T6) of 15° C. By mixing them, the circulation duct has a temperature (T7) of 33° C. The temperature in the circulation duct is gradually decreased and the upper part has a temperature (T8) of 24° C. The cyclone exhaust vent also had a temperature (T9) of 24° C.

The cyclone discharge opening had a temperature (T12) of 19° C. The interior of the mixer-type hopper had a temperature (T4) of 16° C.

As shown by the above measurement result, the to-be-dried object (supplied sample) supplied at 16° C. was subjected to the compressed air of 44° C. to cause the temperature of the to-be-dried object in a cyclone inlet to increase to 24° C. Then, the to-be-dried object subjected to the cyclone discharge opening has a temperature decreased to 19° C. and subsequently has a temperature decreased to 16° C. at the mixer-type hopper. As described above, this apparatus provides a dehumidification drying based on the three steps.

INDUSTRIAL APPLICABILITY

A technique to control, depending on the humidity of a to-be-dried object, the temperature of the to-be-dried object and the temperature of the gas used for dehumidification to thereby improve the drying efficiency can be realized by a relatively-low cost. Thus, this technique has a wide application range and is expected to have a high demand.

DESCRIPTION OF REFERENCE NUMERALS

1 To-be-dried object
10 To-be-dried object temperature control unit
11 Intake vent
12 Exhaust vent
20 Upper transportation apparatus
30 Lower transportation apparatus
40 Elevating apparatus
41 Introduction opening
42 Discharge opening
50 Air blower
51 Inlet
52 Exhaust nozzle
60 Heat pump unit
61 Air to control the temperature of the to-be-dried object
62 Air used for dehumidification
63 First air supply opening
64 Second air supply opening
65 First duct
66 Second duct
70 Apparatus to control the temperature of the to-be-dried object and the temperature of air used for dehumidification
80 Release space
100 Drying apparatus
200 Drying apparatus
201 To-be-dried object
210 Ring-like conveyor
220 Heating apparatus
230 Cooling apparatus
240 Ventilation fan
300 Drying apparatus
301 To-be-dried object
310 Compressed air generation apparatus
311 Compressed air
312 Exhaust vent
320 Space to cool and heat and to ventilate the air used for dehumidification
321 Storage bath for to-be-dried object
330 Duct
331 Inlet for the to-be-dried object
332 discharge opening

What is claimed is:

1. A drying method to dry a to-be-dried object by allowing the to-be-dried object to contact with a gas having a different temperature, comprising:

an introduction process for introducing the to-be-dried object;

a first heating/cooling process for heating or cooling the to-be-dried object to reach a first temperature;

a transportation process for transporting the heated or cooled to-be-dried object;

a humidity comparison process for comparing the to-be-dried object humidity of the to-be-dried object with the gas humidity of gas used for dehumidification;

an atmosphere temperature adjustment process for adjusting, when the to-be-dried object humidity is high, the temperature of the gas used for dehumidification to a second temperature lower than the first temperature and adjusting, when the gas humidity is high, the temperature of the gas used for dehumidification to a second temperature higher than the first temperature;

a dehumidification process for allowing the to-be-dried object to contact with the gas of the second temperature to thereby dehumidify the to-be-dried object; and a removal process for removing the to-be-dried object.

2. The drying method of claim 1, wherein the drying method has, after the dehumidification process, a ventilation process for exchanging the gas used for dehumidification.

3. The drying method of claim 2, wherein prior to the removal process, the to-be-dried object is returned to the first heating/cooling process to repeat the respective processes.

4. The drying method of claim 3, wherein the transportation step uses compressed air to perform transportation.

5. A drying apparatus for drying a to-be-dried object by allowing the to-be-dried object to contact with a gas having a different temperature, comprising:

an introduction means for introducing a to-be-dried object;

a first heating/cooling means for heating or cooling the to-be-dried object to have a first temperature;

a transportation means for transporting the to-be-dried object heated or cooled by the first heating/cooling means;

a humidity comparison means for measuring the humidity of the to-be-dried object after the transportation and the humidity of gas used for dehumidification to perform comparison therebetween;

an atmosphere temperature adjustment means for adjusting, when the humidity of the to-be-dried object is high, the temperature of the gas used for dehumidification to a second temperature lower than the first temperature and adjusting, when the gas humidity is high, the temperature of the gas used for dehumidification to the second temperature higher than the first temperature;

a dehumidification means of allowing the to-be-dried object to contact with the gas of the second temperature to thereby dehumidify the to-be-dried object; and a removal means for removing the to-be-dried object.

6. The drying apparatus of claim 5, wherein the drying apparatus includes a ventilation means for exchanging the gas used for dehumidification.

7. The drying apparatus of claim 6, wherein the transportation means integrally forms the introduction means, the first heating/cooling means, and the removal means and is configured by a space having the atmosphere temperature adjustment means, the dehumidification means, and the ventilation means.

8. The drying apparatus of claim 7, wherein the transportation means performs transportation by compressed air.

9. The drying apparatus of claim 8, wherein the first heating/cooling means and the atmosphere temperature adjustment means use a heat pump.

* * * * *